US007999216B2

(12) United States Patent
DeFlumere et al.

(10) Patent No.: US 7,999,216 B2
(45) Date of Patent: Aug. 16, 2011

(54) SELECTIVE CHANNEL CHARGING FOR MICROCHANNEL PLATE

(75) Inventors: Michael E. DeFlumere, Winchester, MA (US); Joseph M. Schlupf, Newburyport, MA (US); Paul W. Schoeck, Townsend, MA (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 187 days.

(21) Appl. No.: 12/400,490

(22) Filed: Mar. 9, 2009

(65) Prior Publication Data

US 2010/0224763 A1 Sep. 9, 2010

(51) Int. Cl.
*H01J 40/14* (2006.01)

(52) U.S. Cl. ..... 250/214 VT; 250/207

(58) Field of Classification Search ..... 250/207, 250/283, 287, 214 R, 214 VT, 307–309, 397; 313/103 CM, 105 CM, 105 R, 532–535
See application file for complete search history.

(56) References Cited

U.S. PATENT DOCUMENTS 5,544,722 A 8/1996 McKenzie
7,084,393 B2 * 8/2006 Fuhrer et al. ..... 250/283
7,508,131 B2 * 3/2009 Downing et al. ..... 250/214 VT
7,602,122 B2 * 10/2009 Kyushima et al. ..... 313/105 CM
7,687,759 B2 * 3/2010 Brown et al. ..... 250/214 VT
7,880,127 B2 * 2/2011 Garris ..... 250/548
7,880,128 B2 * 2/2011 Garris et al. ..... 250/214 VT

OTHER PUBLICATIONS

Microchannel Plates and MCP Detectors and Imaging Systems, downloaded on Jan. 28, 2009 from http://www.dmphotonics.com/MCP_MCPImageIntensifiers/mcp_references.htm, 14 pages.
"Medipix", downloaded on Feb. 17, 2009 from http://en.wikipedia.org/wiki/Medipix, 2 pages.
Tremsin et al., The Latest Developments of High Gain Si Microchannel Plates; Proc. SPIE, vol. 4854, "Future EUV-UV and Visible Space Astrophysics Missions and Instrumentation", Hawaii (2002); 10 pages.

* cited by examiner

*Primary Examiner* — Seung C Sohn
(74) *Attorney, Agent, or Firm* — Finch & Maloney PLLC; Neil F. Maloney

(57) ABSTRACT

Techniques are disclosed that can be used to increase the dynamic range of a microchannel plate (MCP) device, thereby eliminating the need for conventional techniques such as gating. In one example embodiment, an MCP device is provided that includes a plurality of channels, each channel for amplifying a photoelectron input to the channel and for producing an electron cloud at its output. The device further includes one or more charging switches associated with each channel for allowing charging current to flow so as to charge that channel in response to producing an electron cloud. In some such example cases, the plurality of channels and the one or more switches are implemented in silicon, and the one or more charging switches turn on only in the presence of the electron cloud produced at the corresponding channel output.

20 Claims, 3 Drawing Sheets

SELECTIVE CHANNEL CHARGING FOR MICROCHANNEL PLATE

RELATED APPLICATIONS

This application is related to U.S. application Ser. No. 12/400,505, filed Mar. 9, 2009, and titled "Interface Techniques for Coupling a Microchannel Plate to a Readout Circuit" which is herein incorporated by reference in its entirety.

FIELD OF THE INVENTION

The invention relates to sensors such as microchannel plates (MCPs), and more particularly, to techniques for increasing MCP dynamic range.

BACKGROUND OF THE INVENTION

As is known, a microchannel plate (MCP) includes an array of small diameter tubes or channels, each of which operates as an independent electron multiplier in the presence of an electric field applied to the MCP. As a signal (e.g., an electron, photon, ion) enters the input end of a given channel and passes through that channel, it impacts the channel walls thereby producing so-called secondary electrons that then also propagate through the channel and impact the channel wall to produce even more secondary electrons. This repetitive addition of electrons effectively amplifies the original input signal by several orders of magnitude, depending on factors such as strength of the electric field and channel geometry.

A collector electrode (generally referred to as an anode) is provided at the other end of the channel to collect the multitude of electrons (sometime referred to as an electron pulse or cloud). While some MCP designs have a single anode to collect total current produced by all channels, other MCP designs have a multi-anode configuration where each channel has a dedicated anode. Such a multi-anode MCP configuration is particularly useful when it is necessary to maintain spatial relationships of input signals (e.g., such as the case with imaging applications).

MCP devices can be used in a number of detectors for military, scientific and commercial applications. In general, a detector that employs MCP technology includes a converter (e.g., photocathode) to convert the incident photons into electrons, one or more MCPs that operate to amplify the initial electron or photon event into an electron cloud, and a readout circuit for receiving each electron cloud and converting it into a signal having qualities suitable for subsequent signal processing. MCPs are in general sensitive to photons by a much lower efficiency than a photocathode. In some cases, however, where the MCP is directly sensitive to the target event or particle, no converter is needed (e.g., such as in ion detection in mass-spectrometry applications, and UV and VUV radiation detection applications). In other cases, the converter may further include a scintillator that converts incident particles into photons that are subsequently converted to electrons by a photocathode or other suitable conversion mechanism.

Current microchannel plates are typically made from doped glass, but can also be made from other materials such as silicon. Regardless of the material used, a problem associated with such conventional MCP-based detectors is that they have limited dynamic range due to the maximum current that can be dissipated in the MCP. Specifically, the dynamic range is effectively set by the limit on the strip current (total current flowing through the device). In typical operation, the MCP channels that have had an event (photoelectron) become depleted of charge, and thus the channels must recharge as to be ready for the next event in the channel. To this end, the MCP is connected to a high voltage bias that recharges the channel through the resistance of the plate. This resistance, however, is selected to keep the current below a thermal runaway condition (generally caused by reduction of plate resistance as the temperature increases). Unfortunately, such a constraint increases the time for the charge to build-up in depleted channels. This charge build-up time effectively defines the minimum time limit between when events can be detected. Hence, the dynamic range of MCP-based detectors is limited, and event information may go undetected.

One conventional solution to extend the dynamic range of a MCP-based detector is referred to as gating, which involves turning the photocathode off for part of the integration period. However, there are a number of issues with this approach. First, the complexity of the hardware is increased as well as a loss of signal even in the 100% on state. Second, the so-called dim signals will be lost when gating is implemented. Third, there is a negative impact on signal processing algorithms due to inaccuracies associated with the gating process, which gives rise to a need for calibration.

There is a need, therefore, for techniques that can be used to increase the dynamic range of an MCP device.

SUMMARY OF THE INVENTION

One embodiment of the present invention provides a microchannel plate (MCP) device. The device includes a plurality of channels, each channel for amplifying a photoelectron input to the channel and for producing an electron cloud at its output. The device further includes one or more charging switches associated with each channel for allowing charging current to flow so as to charge that channel in response to producing an electron cloud. The device may further include an input electrode at the channel inputs, and an output electrode at the channel outputs. A bias can be applied across the electrodes to provide the charging current. In one particular case, the plurality of channels and the one or more switches are implemented in silicon. Other suitable materials will be apparent in light of this disclosure. In another particular case, each of the channels is associated with distributed capacitance and resistance selected to accommodate a desired dynamic range. In another particular case, the one or more charging switches are implemented with transistors operatively coupled between distributed resistance of the corresponding channel and an output electrode of the device. In one such case, the electron cloud has an electric field, and when the electron cloud reaches the channel output, the electric field causes the one or more transistors associated with that channel to momentarily switch to an on state thereby allowing current to flow in regions around that channel that gave up charge during amplifying of the photoelectron. In another particular case, the one or more charging switches are provided proximate to the output of the corresponding channel. In another particular case, the one or more charging switches turn on only in the presence of the electron cloud produced at the corresponding channel output. In another particular case, the one or more charging switches are implemented with field effect transistors (FETs) and the electron cloud has an electric field, and when the electron cloud reaches the channel output, the electric field causes the one or more FETs associated with that channel to momentarily switch to an on state thereby allowing current to flow in regions around that channel that gave up charge during amplifying of the photoelectron. In one such case, each of the one or more FETs includes a gate, and the electric field at the output of the channel conducts to the gate of each FET, thereby momentarily switching each FET to its on state. The MCP device may be configured with numerous variations and configurations as will be apparent in light of this disclosure. Any combination of the features and/or various cases discussed herein may be employed.

Another embodiment of the present invention provides a system that includes one or more optics for collecting photons from a scene within a field of view (FOV) of the system. The system further includes a converter for converting photons collected by the optics to electrons, and a readout integrated circuit (ROIC) for converting each electron cloud into a signal for subsequent signal processing. A readout interface is also provided for interfacing the MCP with the ROIC. The system further includes an MCP device, which may be configured as previously described, with numerous variations and configurations apparent in light of this disclosure. Each of the MCP device, readout interface, and ROIC are included in a vacuum.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION OF THE INVENTION

Figure 1:
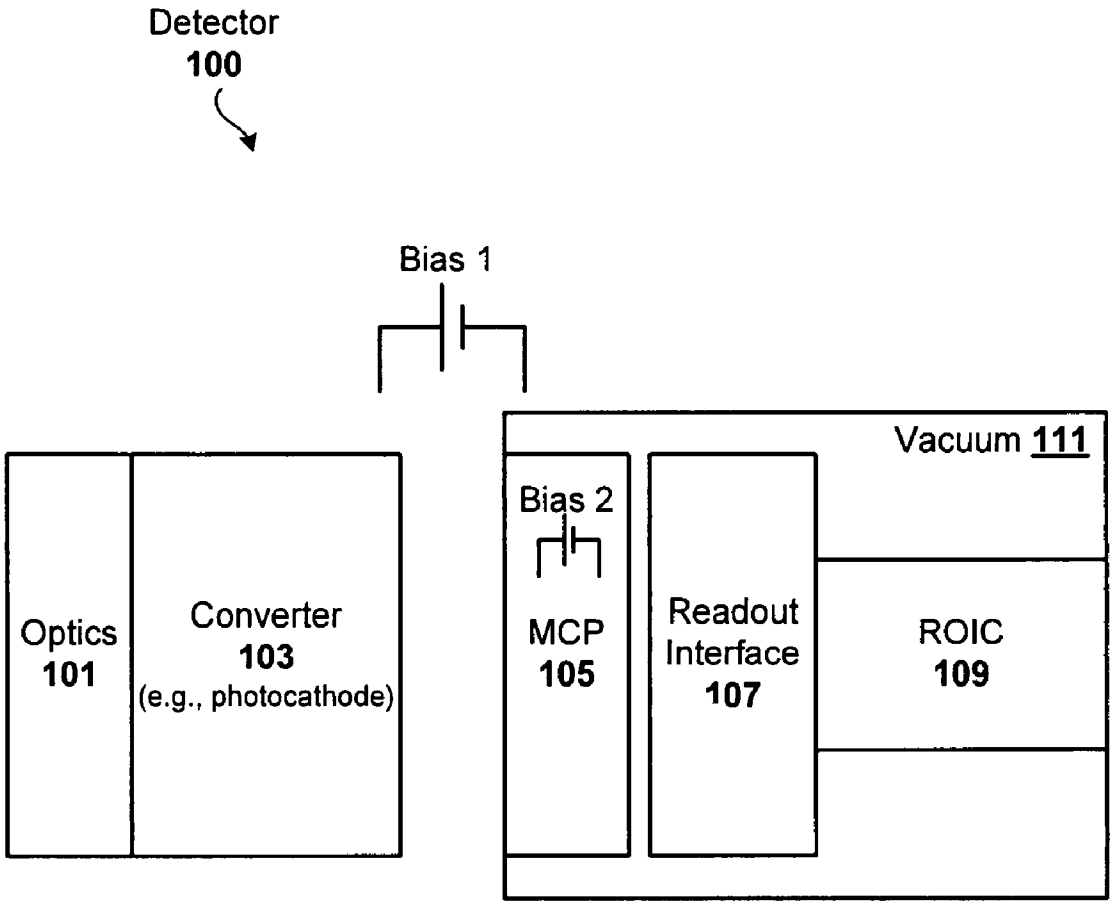
FIG. 1 illustrates a detector configured in accordance with an embodiment of the present invention.

Techniques are disclosed that can be used to increase the dynamic range of a microchannel plate (MCP) device, thereby eliminating the need for conventional techniques such as gating.

General Overview

As previously explained, conventional MCP devices have limited dynamic range due to the maximum current that can be dissipated in the device. Thus, when the MCP channels that have had an event (photoelectron) become depleted of charge, those channels need to recharge to be ready for the next event in the channel. To this end, the MCP is typically connected to a high voltage bias that recharges the channel through the resistance of the plate. This resistance, however, is selected to keep the current below a thermal runaway condition, which increases the time for the charge to build-up in depleted channels. This charge build-up time effectively defines the minimum time limit between when events can be detected. Hence, the dynamic range of conventional MCP-based detectors is limited, and event information may go undetected.

This is true for MCPs made from doped glass (typical MCP material), as well as for MCPs made from other materials such as silicon. However, and in accordance with an embodiment of the present invention, an MCP device is formed from a material that can be doped to have low resistance (such as silicon) or otherwise exhibits low resistance so that the channel recharge time is short. In addition, thermal runaway from high channel current is avoided by integrating or otherwise building a switching device (e.g., MOSFET, or other suitable switch) at the exit side of each channel to control the charging current in that channel.

For those channels that do not have an event, the corresponding channel switch is in a high resistance (off) state. Thus, no charging current flows into, and no heat is dissipated by, that channel. On the other hand, if an event propagates down a channel, the field produced by the space charge (associated with the electron cloud provided by secondary emissions) causes the corresponding channel switch to transition to a low resistance (on) state, thereby increasing or otherwise allowing charging current into the channel so as to charge it to be ready for the next event. The result of such selective channel switching/charging is that the dynamic range of each active channel is dynamically increased. This type of operation is particularly useful for sensing situations were there are weak signals that are localized interspersed with intense signals, thereby driving the requirement for high dynamic range.

The switches may be operatively coupled to the MCP device, or integrated monolithically into the MCP device (i.e., integrally formed with the MCP device). An MCP device configured with a channel switching scheme in accordance with an embodiment of the present invention can be implemented, for example, in silicon thereby allowing use of well-established semiconductor processing and/or micromachining fabrication techniques. In other embodiments, a switching circuit made from one material (e.g., silicon) can be abutted to or otherwise operatively coupled to an MCP formed from another material (e.g., doped glass). A number of materials and integration levels will be apparent in light of this disclosure. Note, however, that the high processing temperature of a silicon-based MCP design, relative to doped glass MCP designs, beneficially allows coating deposition on the microchannel plate for filtering and improved detection. In addition, this high processing temperature is compatible with the fabrication of high performance photocathodes using wide band gap materials.

Detector System

FIG. 1 illustrates a detector system 100 configured in accordance with an embodiment of the present invention. As can be seen, the system 100 includes optics 101, converter 103, microchannel plate (MCP) 105, readout interface 107, and readout integrated circuit (ROIC) 109. Each of the MCP 105, readout interface 107, and ROIC 109 are included in a vacuum 113. A bias is provided between the converter 103 and input of the MCP 105, as typically done. Such a system can be used, for example, for any number of image intensifier applications such as night vision, surveillance, or other such applications based on light reflection or emission.

The optics 101 can be implemented with conventional technology, and operates to collect scene data from the system's field of view (FOV) and focuses or otherwise provides that data to the converter 103. As is known, the type and complexity of the optics can vary depending on a number of factors including desired performance, acceptance angle, cost, and wavelengths of interest. In any such cases, photons of interest in the system's FOV are collected and provided to the converter 103 for conversion to electrons via the photoelectric effect. The converter 103 can also be implemented with conventional technology, such as a photocathode. An electron output by the converter 103 is accelerated toward the MCP 105 due to the bias (Bias 1) between the converter 103 and the MCP 105 input. Bias 1 can be, for example, about 300 VDC or any voltage suitable for negatively biasing the converter 103 with respect to the MCP 105.

The MCP 105 generally includes an array of small diameter tubes or channels, each of which operates as an independent electron multiplier in the presence of a bias (Bias 2) applied across the input and output electrodes of the MCP (e.g., 3000 VDC, or other suitable MCP bias). As an electron enters the input end of a given channel and passes through that channel, it impacts the channel walls thereby producing secondary electrons that then also propagate through the channel and impact the channel wall to produce even more secondary electrons. This repetitive addition of electrons amplifies the original input signal, and the resulting electron cloud is provided at the output of the MCP 105. As previously explained, once the channel of the MCP 105 outputs the electron cloud, that channel is depleted of charge, and thus needs to recharge to as to be ready for the next event in the channel.

To this end, the MCP 105 is connected to a high voltage bias that recharges the channel through the resistance of the plate, as typically done. However, the MCP 105 is further configured to avoid thermal runaway associated with high channel current and operates with a significantly higher dynamic range, relative to conventional MCP devices. In particular, and in accordance with an embodiment of the present invention, an MCP 105 is implemented with silicon (or other suitable material that can be doped to have low resistance, or otherwise exhibits low resistance so that channel recharge time is short). In addition, a switching device (e.g., MOSFET, or other suitable switch) is implemented at the exit side of each channel between the channel output and the output electrode, so as to control the flow of charging current from Bias 2 in that channel. These switches are referred to herein as dynamic charging switches. Additional details of MCP 105 will be provided with reference to FIGS. 2*a-b* and 3.

Note that two or more MCPs can be coupled in series to provide even greater amplification for a given input event, as is sometimes done. For instance, an assembly of two MCPs (sometimes called a Chevron or V-stack), or three MCPs (sometimes called a Z-stack) may be used in place of single MCP 105. In short, any number of MCPs can be used and configured in accordance with an embodiment of the present invention, and the number of MCPs required will depend on demands and various particulars of the target application. Each MCP in the stack can be configured individually with dynamic charging switches. Alternatively, the channels of the individual MCPs in the stack can be precisely aligned to effectively provide single long channels that run through the stack. In such cases, the last MCP in the stack can be configured with dynamic charging switches, just as if there were only one MCP.

The readout interface 107 operatively couples the MCP 105 to ROIC 109, and can be implemented, for example with conventional technology such as an optical taper, which typically involves a conversion from electrons to light at the MCP output using a phosphor. In another example embodiment, the readout interface 107 can be implemented as described in the previously incorporated U.S. Application No. 12/400,505. The interface described there can be used to interface an MCP to a readout circuit, and includes a segmented anode, a ROIC interconnect to interface with the ROIC, and at least one interconnect layer for physically connecting each anode pad to a corresponding ROIC pad (e.g., using conductive runs, vias, and metal contacts). A gap is provided between the output of the MCP 105 and the anode of the readout interface 107. The gap is generally small (e.g., on the order of 0.2 mm to 0.4 mm), within good design practice, to minimize the spreading of the electron cloud on the anode. Note that in segmented anode configurations, each anode pad receives a detection signal from a corresponding channel of the MCP. Such a multi-anode MCP configuration is particularly useful when it is necessary to maintain spatial relationships of input signals (e.g., such as the case with imaging applications). Other embodiments may have a readout interface 107 configured with a single (non-segmented) anode that collects the total current produced by all the MCP channels.

The ROIC 109, which can be implemented with conventional technology such as a Medipix ROIC, includes a pad array that corresponds to an interconnect array of the readout interface 107. As is known, Medipix is a family of photon counting pixel detectors developed by an international collaboration hosted by CERN. In any case, the ROIC 109 can be secured to the ROIC interconnect of the readout interface 107 using conventional technology, such as bump bonding. In a segmented anode configuration, each anode pad (and its corresponding ROIC interconnect pad and ROIC pad) effectively corresponds to a pixel of the detector 100. The ROIC 109 receives each pixel signal and converts it into a signal having qualities suitable for subsequent signal processing as conventionally done (e.g., image analysis, discrimination, etc).

MCP with Selective Channel Charging

Figure 2B:
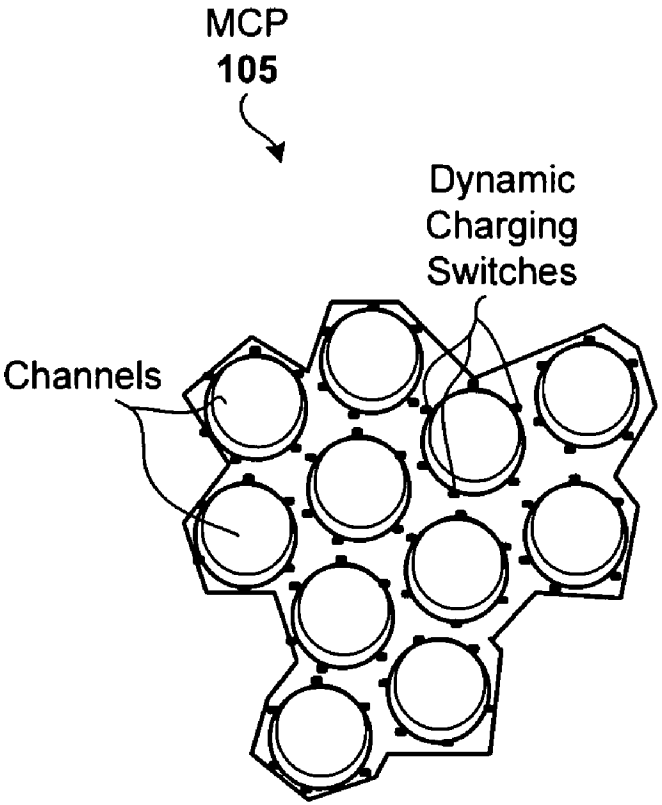
FIG. 2*b* illustrates dynamic charging switches deployed at channel outputs of an MCP to allow for selective channel charging in accordance with an embodiment of the present invention.
Figure 2A:
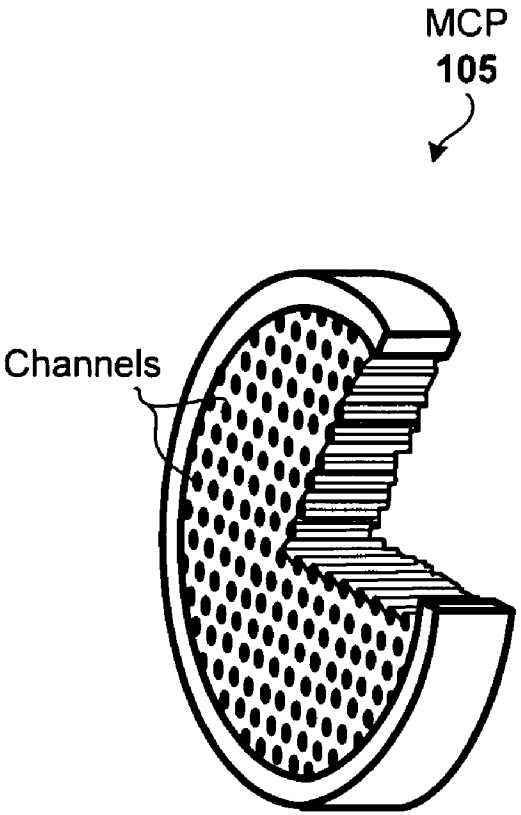
FIG. 2*a* illustrates a perspective cut-away view of a microchannel plate (MCP) device configured in accordance with an embodiment of the present invention.

FIG. 2*a* illustrates a perspective cut-away view of MCP 105, and FIG. 2*b* illustrates dynamic charging switches deployed at channel outputs of MCP 105 in accordance with an embodiment of the present invention. As previously explained, the switches allow for selective channel charging, which allows for significantly higher dynamic range relative to conventional MCP designs.

The MCP 105 can be made of any number of suitable materials, such as doped glass and/or silicon. If different materials are used for the MCP channel array and the switches, then further consideration to issues such as interfacing the two materials will be necessary, and therefore increase complexity. For instance, given different coefficients of thermal expansion between the channel array and switching structure, a graded buffer that gradually transitions from one material to the other may be used to facilitate interface. To eliminate such issues, and in accordance with one embodiment, both the channel array and the switches are implemented with the same material (e.g., silicon substrate having channel array formed thereon, and MOSFET switches implemented in silicon at array output, using standard semiconductor processing techniques).

In one example embodiment, MCP 105 is implemented in silicon, and the dynamic charging switches are implemented as MOSFETs at multiple locations around the perimeter of each channel output. The example shown in FIG. 2*b* includes six switches per channel, but other embodiments may include any number of switches sufficient to effectively allow for selective channel charging as described herein. The number of switches used per channel will depend on factors such as channel pore size, switch feature sizes and fabrication techniques, as well as resistance and dielectric constant of material used to fabricate the MCP, desired channel charge time and charge amount, and power dissipation rating/capabilities per switch. Given MOSFET feature sizes capable with currently available semiconductor processing techniques, there may be hundreds of MOSFETs formed about the channel output, if necessary. As fabrication techniques further improve, even smaller features sizes may be possible, thereby allowing for even more switches per channel output.

For instance, each channel output can be configured, for example, with a pore diameter of 2 to 20 microns (5 micron diameter is typical). In one specific such embodiment, a 5 micron channel diameter provides a circumference of about 15.71 microns, about which one hundred or more 100 nanometer MOSFETs could be readily fabricated. In any case, each of the MOSFETs is operatively coupled, such that its source (or drain) is coupled to the resistive/capacitive network of the channel and its drain (or source) is coupled to the output electrode. When an electron enters the channel input, the resulting electric field or space charge at the output of the channel conducts to the gate of each MOSFET, thereby momentarily switching the MOSFET to its on state (e.g., for a few tens of microseconds). In some configurations, a gate capacitor can be used to hold the MOSFET in its on state for a time that is longer than the channel output electron cloud pulse (which is about 1 ns). This in turn allows charging current to flow into the output electrode, thereby allowing that particular channel to charge so that it will be ready for a next event captured at the channel input.

Figure 3:
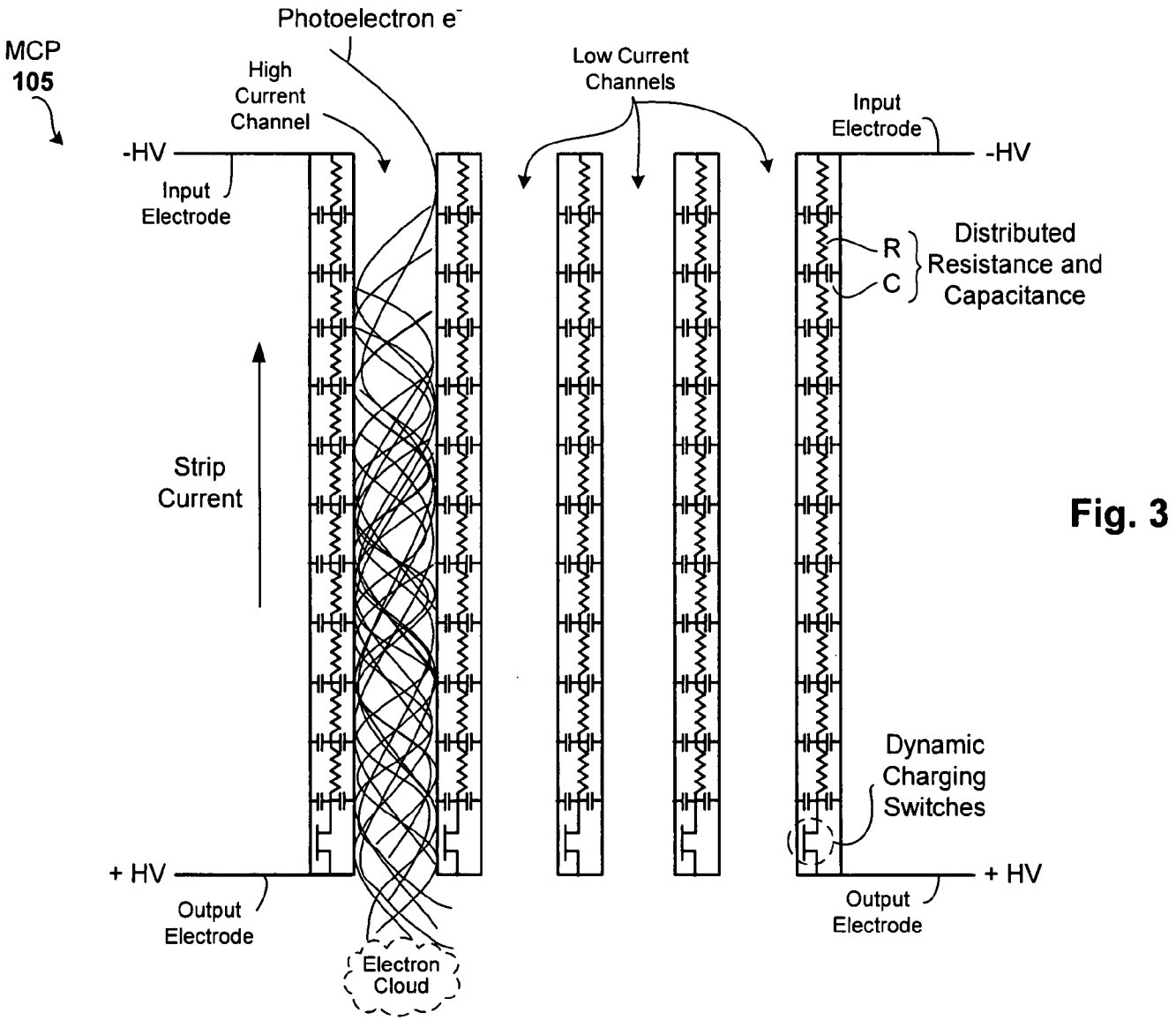
FIG. 3 illustrates a detailed schematic representation of an MCP device configured with dynamic charging switches in accordance with an embodiment of the present invention.

FIG. 3 illustrates a detailed schematic representation of an MCP 105 configured with dynamic charging switches in accordance with an embodiment of the present invention. As can be seen, the MCP 105 has a plurality of channels between two electrodes. A high voltage bias (HV) is applied across the electrodes to charge the channels, such that −HV is applied to the input electrode and +HV is applied to the output electrode. When a photoelectron $e^-$ enters a charged channel, it contacts the channel walls thereby causing secondary emissions. The resulting electron cloud is produced at the output of the channel, which is typical of an MCP device.

However, the channels of MCP 105 are further configured for dynamic charging of depleted channels. In more detail, each of the channels is associated with distributed capacitance (C) and resistance (R) as shown in FIG. 3. The capacitance is fixed by geometry and dielectric constant of the material used to fabricate the plate. The resistance can be as low as desired, which allows for increased strip current for a given gain (proportional to HV). This increase in strip current, which is the charging current, makes for faster recharge times (and high dynamic range). If all of the low resistance channels were allowed to charge at such a high rate, the MCP 105 would likely be susceptible to thermal runaway.

To prevent such thermal runaway, dynamic charging switches are provided at the output of each channel. These switches turn on only momentarily when a space charge (electron cloud) is produced at the channel output, allowing the strip current (charging current) to flow to charge the channel. In this sense, the switches are automatically or dynamically turned on only when they need to be, to allow for channel charging. This selective channel charging allows depleted channels to charge, as opposed to all channels. In addition, the channel charging for any one channel is limited to a relatively short period of time, as the on-time of the dynamic charging switches is limited to the momentary presence of the electron cloud at the output of the channel. Thus, even if all MCP channels simultaneously recharge, thermal runaway is avoided given the limited time in which strip current is allowed to flow.

Assume, for example, that the MCP 105 is implemented in silicon and the dynamic charging switches are MOSFETs (implemented in silicon as conventionally done). To achieve high strip current (and therefore fast recharge time), the silicon MCP is doped to a high conductivity level. Each MOSFET is in a high resistance state (off) when there is no signal in the channel. This keeps the strip current in a low or otherwise normal operating range. A shunt resistor may be added to set this value since the impedance of a MOSFET is quite high.

In any case, when a photoelectron $e^-$ enters a channel, it impacts the wall a number of times releasing secondary electrons which causes the number of electrons to rapidly build up as they propagate down the channel, as previously explained. When the cloud of electrons reaches the channel output, the electric field produced causes the MOSFET (or MOSFETs) associated with that channel to momentarily switch on (e.g., for about a few tens of microseconds, depending on the size of the gate capacitor (if any), the gate sensitivity of the MOSFET, and the magnitude of the field associated with the electron cloud) thereby allowing a large current to flow in the regions around that channel that has had it charge depleted by the building signal. Thus, the channel is allowed to recharge in a much shorter period of time, relative to conventional MCPs. Note that the momentary on-times of the MOSFET (or other suitable switch) can be varied as desired, and the present invention is not intended to be limited to a particular range of on-times (e.g., on-times may range from tens of nanoseconds to several seconds).

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A microchannel plate (MCP) device, comprising:

a plurality of channels, each channel for amplifying a photoelectron input to the channel and for producing an electron cloud at its output; and one or more charging switches associated with each channel for allowing charging current to flow so as to charge that channel in response to producing an electron cloud.

2. The device of claim 1 further comprising:

an input electrode at the channel inputs; and an output electrode at the channel outputs;

wherein a bias applied across the electrodes provides the charging current.

3. The device of claim 1 wherein the plurality of channels and the one or more switches are implemented in silicon.

4. The device of claim 1 wherein each of the channels is associated with distributed capacitance and resistance selected to accommodate a desired dynamic range.

5. The device of claim 1 wherein the one or more charging switches are implemented with transistors operatively coupled between distributed resistance of the corresponding channel and an output electrode of the device.

6. The device of claim 5 wherein the electron cloud has an electric field, and when the electron cloud reaches the channel output, the electric field causes the one or more transistors associated with that channel to momentarily switch to an on state thereby allowing current to flow in regions around that channel that gave up charge during amplifying of the photoelectron.

7. The device of claim 1 wherein the one or more charging switches are provided proximate to the output of the corresponding channel.

8. The device of claim 1 wherein the one or more charging switches turn on only in the presence of the electron cloud produced at the corresponding channel output.

9. The device of claim 1 wherein the one or more charging switches are implemented with field effect transistors (FETs)

and the electron cloud has an electric field, and when the electron cloud reaches the channel output, the electric field causes the one or more FETs associated with that channel to momentarily switch to an on state thereby allowing current to flow in regions around that channel that gave up charge during amplifying of the photoelectron.

10. The device of claim 9 wherein each of the one or more FETs includes a gate, and the electric field at the output of the channel conducts to the gate of each FET, thereby momentarily switching each FET to its on state.

11. A microchannel plate (MCP) device, comprising:

a plurality of channels, each channel for amplifying a photoelectron input to the channel and for producing an electron cloud at its output;

one or more charging switches associated with each channel for allowing charging current to flow so as to charge that channel in response to producing an electron cloud, wherein the one or more charging switches turn on only in the presence of the electron cloud produced at the corresponding channel output;

an input electrode at an input of the channels; and an output electrode at the channel outputs;

wherein a bias applied across the electrodes provides the charging current.

12. The device of claim 11 wherein the plurality of channels and the one or more switches are implemented in silicon.

13. The device of claim 11 wherein the electron cloud has an electric field and the one or more charging switches are implemented with transistors operatively coupled between distributed resistance of the corresponding channel and the output electrode, and when the electron cloud reaches the channel output, the electric field causes the one or more transistors associated with that channel to momentarily switch to an on state thereby allowing current to flow in regions around that channel that gave up charge during amplifying of the photoelectron.

14. The device of claim 11 wherein the one or more charging switches are implemented with field effect transistors (FETs) and the electron cloud has an electric field, and when the electron cloud reaches the channel output, the electric field causes the one or more FETs associated with that channel to momentarily switch to an on state thereby allowing current to flow in regions around that channel that gave up charge during amplifying of the photoelectron.

15. The device of claim 14 wherein each of the one or more FETs includes a gate, and the electric field at the output of the channel conducts to the gate of each FET, thereby momentarily switching each FET to its on state.

16. A system comprising:

one or more optics for collecting photons from a scene within a field of view (FOV) of the system;

a converter for converting photons collected by the optics to electrons;

a readout interface for interfacing the MCP with the ROIC;

a readout integrated circuit (ROIC) for converting each electron cloud into a signal for subsequent signal processing; and a microchannel plate (MCP) device comprising:

a plurality of channels, each channel for amplifying a photoelectron input to the channel and for producing an electron cloud at its output; and one or more charging switches associated with each channel for allowing charging current to flow so as to charge that channel in response to producing an electron cloud;

wherein each of the MCP device, readout interface, and ROIC are included in a vacuum.

17. The system of claim 16 further comprising:

an input electrode at the channel inputs; and an output electrode at the channel outputs;

wherein a bias applied across the electrodes provides the charging current.

18. The system of claim 16 wherein the plurality of channels and the one or more switches are implemented in silicon, and the one or more charging switches turn on only in the presence of the electron cloud produced at the corresponding channel output.

19. The system of claim 16 wherein the electron cloud has an electric field and the one or more charging switches are implemented with transistors operatively coupled between distributed resistance of the corresponding channel and an output electrode of the device, and when the electron cloud reaches the channel output, the electric field causes the one or more transistors associated with that channel to momentarily switch to an on state thereby allowing current to flow in regions around that channel that gave up charge during amplifying of the photoelectron.

20. The system of claim 16 wherein the one or more charging switches are implemented with field effect transistors (FETs) each having a gate, and the electron cloud has an electric field, and when the electron cloud reaches the channel output, the electric field conducts to the gate of each FET, thereby momentarily switching each FET to its on state and allowing current to flow in regions around that channel that gave up charge during amplifying of the photoelectron.

* * * * *